US006995965B2

(12) United States Patent
Hameed et al.

(10) Patent No.: US 6,995,965 B2
(45) Date of Patent: Feb. 7, 2006

(54) CLOTHES DRYER OVER-VOLTAGE CONTROL APPARATUS AND METHOD

(75) Inventors: Zubair Hameed, Louisville, KY (US); Scott Wayne Lange, Louisville, KY (US); Douglas Allen Riddle, Louisville, KY (US)

(73) Assignee: General Electric Company, Schenectady, NY (US)

( * ) Notice: Subject to any disclaimer, the term of this patent is extended or adjusted under 35 U.S.C. 154(b) by 292 days.

(21) Appl. No.: 10/317,968

(22) Filed: Dec. 12, 2002

(65) Prior Publication Data

US 2004/0123486 A1 Jul. 1, 2004

(51) Int. Cl.
*H02H 9/04* (2006.01)

(52) U.S. Cl. ..... 361/91.1; 34/595

(58) Field of Classification Search ..... 34/595; 219/494; 323/241; 361/91.1
See application file for complete search history.

(56) References Cited

U.S. PATENT DOCUMENTS 4,809,128 A * 2/1989 Geary ..... 361/264
4,859,926 A * 8/1989 Wolze ..... 323/241
5,672,941 A * 9/1997 Callahan et al. ..... 315/194
5,981,918 A * 11/1999 Topp et al. ..... 219/499
6,137,702 A * 10/2000 Hall et al. ..... 363/95
6,188,208 B1 * 2/2001 Glaser et al. ..... 323/235
6,271,506 B1 * 8/2001 Glaser ..... 219/505
6,404,171 B2 * 6/2002 Saida ..... 323/239
6,765,180 B2 * 7/2004 Mathews et al. ..... 219/492

* cited by examiner

*Primary Examiner*—Brian Sircus
*Assistant Examiner*—Boris Benenson
(74) *Attorney, Agent, or Firm*—George L. Rideout, Jr.; Armstrong Teasdale LLP

(57) ABSTRACT

An over-voltage control device for a clothes dryer including an electrical heater coupled to an alternating current power supply is provided. The device includes a switch device adapted to connect and disconnect the power supply from the heater, and a micro-controller coupled to the switch device. The switch device is responsive to said micro-controller, and the micro-controller is configured to operate said switch to maintain an effective heater voltage below a predetermined threshold to avoid tripping of a circuit breaker.

19 Claims, 4 Drawing Sheets

CLOTHES DRYER OVER-VOLTAGE CONTROL APPARATUS AND METHOD

BACKGROUND OF THE INVENTION

This invention relates generally to dryer systems, and, more particularly, to control systems for clothes dryers.

An appliance for drying articles such as a clothes dryer for drying clothing articles typically includes a cabinet including a rotating drum for tumbling clothes and laundry articles therein. One or more heating elements heats air prior to air entering the drum, and the warm air is circulated through the air as the clothes are tumbled to remove moisture from laundry articles in the drum. See, for example, U.S. Pat. No. 6,141,887.

In an electric clothes dryer, a current is caused to flow in one or more electrical heaters to heat air introduced to the drum with a fan. A resistance value of the heater is based upon the desired capacity of the heater, and the heater is rated to operate at a predetermined voltage (e.g., 240 Volts AC). The input voltage to the heater, however, fluctuates over time. A voltage of a power source line may, for example, fluctuate up to 10%, of the rated value thereof. When the actual input voltage to the dryer is above the rated voltage (referred to herein as an over-voltage condition), current flowing through the heater is accordingly increased. In some cases, the current drawn by the heaters in an over-voltage condition can cause household circuit breakers to trip, thereby opening the circuit through the dryer. Tripping of circuit breakers due to dryer operation is both an impediment to dryer operation and a great inconvenience to dryer users who must reset the circuit breaker.

At least one known electric dryer system includes a control circuit apparatus including a switching device for opening and closing an electrical connection between a power source and a heater in an over-voltage condition to prevent overheating of the dyer and associated damage to machine components and clothing articles. The control circuit includes a comparator that produces an over-voltage signal corresponding to a difference between the supply voltage and a predetermined reference voltage corresponding to the heater rating. A pulse width of the over-voltage signal is counted, and a time value of the period to open the heater circuit is calculated by scaling a target pulse width by one of a plurality of experimentally determined constants $\alpha$ read from a table in a memory. Each constant a corresponds to the counted pulse width of the over-voltage signal, and the constants are selected to scale the target pulse width to maintain heater power consumption per unit time at the same level as if the heater operated at the rated voltage. See U.S. Pat. No. 4,469,654.

Unfortunately, the constants applicable to one machine are not necessarily applicable to another machine with different components. Therefore, constants must experimentally determined for each different machine. It would be desirable to provide a universal over-voltage control for a clothes dryer applicable across a variety of clothes dryer platforms.

BRIEF DESCRIPTION OF THE INVENTION

In one aspect, an over-voltage control device for a clothes dryer including an electrical heater coupled to an alternating current power supply is provided. The device comprises a switch device adapted to connect and disconnect the power supply from the heater, and a micro-controller coupled to said switch device, said switch device responsive to said micro-controller, said micro-controller configured to operate said switch to maintain an effective heater voltage below a predetermined threshold to avoid tripping of a circuit breaker.

In another aspect, an over-voltage control system for a clothes dryer including an electrical heater is provided. The control system comprises a switch device adapted to disconnect the heater from an alternating current power supply, a voltage converter coupled to the heater, and a micro-controller coupled to said voltage converter and operatively coupled to the heater. The micro-controller is configured to compare a signal from the voltage converter to a predetermined threshold value, and when the reference voltage is greater than the threshold value to operate said switch device to maintain an effective voltage applied to the heater at a voltage level below a rated voltage of the heater.

In another aspect, a clothes dryer is provided. The dryer comprises a cabinet, a drum rotatably mounted within said cabinet, a fan for circulating air within said drum, an electrical heater for warming air circulated by said fan; a switch device coupled between said heater and an alternating current power supply, and a controller coupled to said switch device and configured to operate said switch to achieve a step reduction in the power supply voltage to the heater through said switch device, said step reduction governed by the relationship $$V_{step} = \frac{V_{ave}}{N * t}$$

where $V_{ave}$ is a heater rated voltage, N is a frequency of the input power supply, and t is a predetermined time period for over-voltage compensation.

In another aspect, a method for controlling an electrical heater of a clothes dryer in an over-voltage condition is provided. The clothes dryer includes a controller coupled to a switch device for regulating a power supply input to the heater through operation of the switch., and the method comprises comparing an effective heater voltage to a threshold heater voltage, and when the effective heater voltage is greater than the threshold voltage, opening the switch device to disconnect the power supply from the heater, said opening of the switch device for a predetermined number of voltage cycles on a periodic basis.

In another aspect, a method for operating a clothes dryer to avoid tripping of a circuit breaker rated at a threshold voltage for an alternating current power supply is provided. The dryer includes an electrical heater, a voltage converter adapted for generating a DC voltage reference signal corresponding to the actual voltage across the heater, a switch device for regulating a power supply input to the heater through operation of the switch, and a controller coupled to the voltage converter and to the switch device. The method comprising closing the switch device to energize the heater, comparing the DC voltage reference signal to a voltage threshold that corresponds to a rated voltage of the heater minus an over-voltage compensation value, when the DC voltage reference signal is greater than the voltage step differential, opening the switch device to disconnect the heater from the power supply and reduce an effective voltage applied to the heater through the switch device by one voltage step, the voltage step defined by the relationship $$V_{step} = \frac{V_{ave}}{N * t}$$

where $V_{ave}$ is a heater rated voltage, N is a frequency of the input power supply, and t is a predetermined time period for over-voltage compensation, closing the switch device for a remainder of time t to connect the power supply to the heater; and repeating opening of the switch device to achieve step reduction of voltage cycles to the heater upon the occurrence of every t time period.

DETAILED DESCRIPTION OF THE INVENTION

Figure 1:
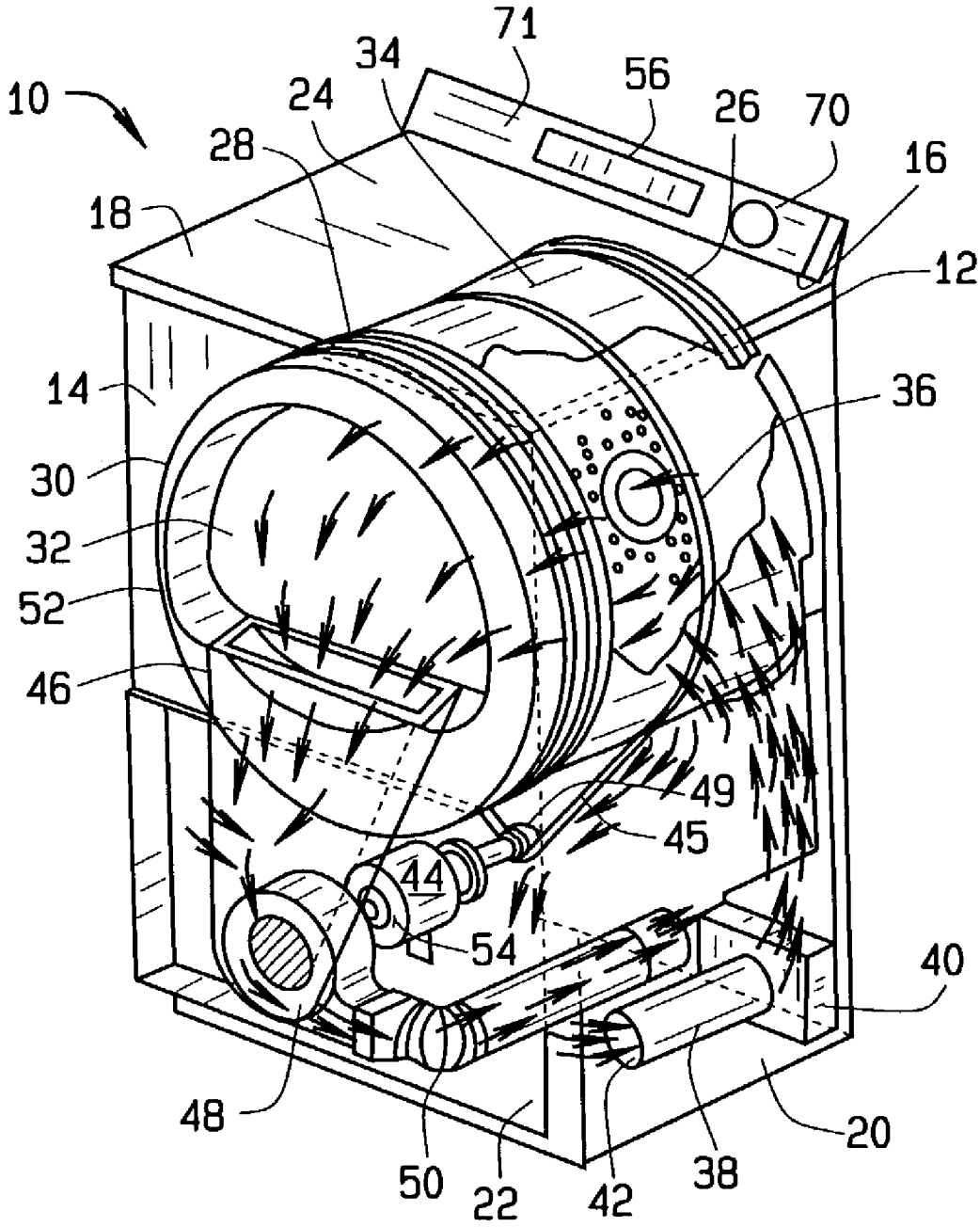
FIG. 1 is perspective broken away view of an exemplary dryer appliance.

FIG. 1 illustrates an exemplary clothes dryer appliance 10 in which the present invention may be practiced. While described in the context of a specific embodiment of dryer 10, it is recognized that the benefits of the invention may accrue to other types and embodiments of dryer appliances. Therefore, the following description is set forth for illustrative purposes only, and the invention is not intended to be limited in practice to a specific embodiment of dryer appliance, such as dryer 10.

Clothes dryer 10 includes a cabinet or a main housing 12 having a front panel 14, a rear panel 16, a pair of side panels 18 and 20 spaced apart from each other by the front and rear panels, a bottom panel 22, and a top cover 24. Within cabinet 12 is a drum or container 26 mounted for rotation around a substantially horizontal axis. A motor 44 rotates the drum 26 about the horizontal axis through a pulley 43 and a belt 45. The drum 26 is generally cylindrical in shape, having an imperforate outer cylindrical wall 28 and a front flange or wall 30 defining an opening 32 to the drum for loading and unloading of clothing articles and other fabrics.

A plurality of tumbling ribs (not shown) are provided within drum 26 to lift clothing articles therein and then allow them to tumble back to the bottom of drum 26 as the drum rotates. The drum 26 includes a rear wall 34 rotatably supported within the main housing 12 by a suitable fixed bearing. The rear wall 34 includes a plurality of holes 36 that receive hot air that has been heated by an electrical heater 40 in communication with an air supply duct 38. The heated air is drawn from the drum 26 by a blower fan 48 which is also driven by the motor 44. The air passes through a screen filter 46 which traps any lint particles. As the air passes through the screen filter 46, it enters a trap duct seal and is passed out of the clothes dryer through an exhaust duct 50. After the clothing articles have been dried, they are removed from the drum 26 via the opening 32.

A cycle selector knob 70 is mounted on a cabinet backsplash 71 and is in communication with a controller 56. Signals generated in controller 56 operate the drum drive system and heating elements in response to a position of selector knob 70.

Figure 2:
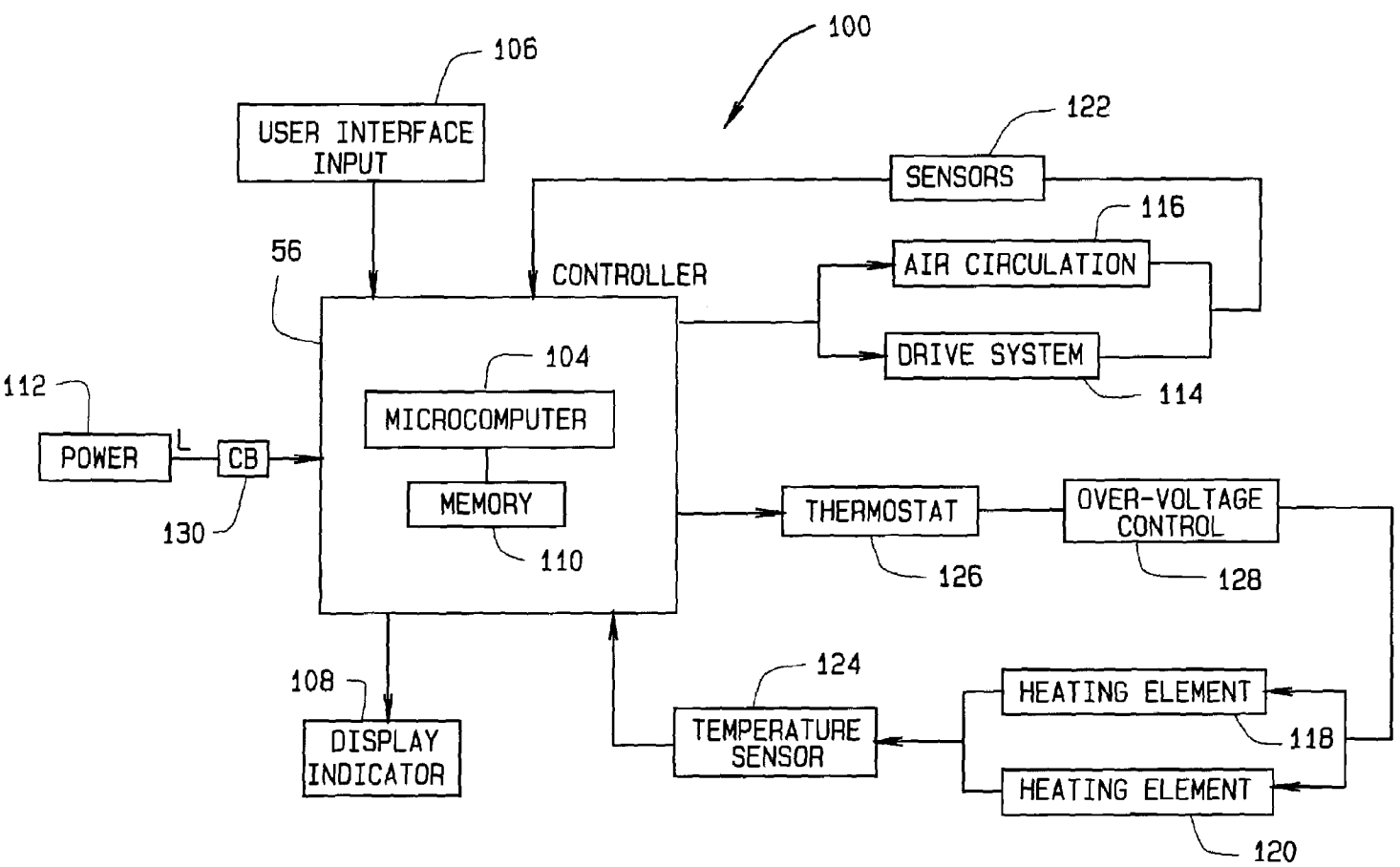
FIG. 2 is a schematic diagram of a control system for the appliance shown in FIG. 1.

FIG. 2 is a schematic diagram of an exemplary washing machine control system 100 for use with dryer 10 (shown in FIG. 1). Control system 100 includes controller 56 which may, for example, be a microcomputer 104 coupled to a user interface input 106 such as, for example, cycle selector knob 70 (shown in FIG. 1). An operator may enter instructions or select desired dryer cycles and features via user interface input 106 and in one embodiment a display or indicator 108 is coupled to microcomputer 104 to display appropriate messages and/or indicators, such as a timer, and other known items of interest to dyer users. A memory 110 is also coupled to microcomputer 104 and stores instructions, calibration constants, and other information as required to satisfactorily complete a selected dry cycle. Memory 110 may, for example, be a random access memory (RAM). In alternative embodiments, other forms of memory could be used in conjunction with RAM memory, including but not limited to electronically erasable programmable read only memory (EEPROM).

Power to control system 100 is supplied to controller 56 by a power supply 112 configured to be coupled to a power line L. Analog to digital and digital to analog converters (not shown) are coupled to controller 56 to implement controller inputs and executable instructions to generate controller output to dryer components such as those described above in relation to FIG. 1. More specifically, controller 56 is operatively coupled to machine drive system 114 (e.g., motor 44 shown in FIG. 1), an air circulation system 116 (e.g., blower fan 48) and electrical heating elements 118, 120 according to known methods. While two heating elements 118, 120 are illustrated in FIG. 2, it is recognized that greater or fewer heaters may be employed within the scope of the present invention.

In response to manipulation of user interface input 106 controller 56 monitors various operational factors of dryer 10 with one or more sensors or transducers 122, and controller 56 executes operator selected functions and features according to known methods. Of course, controller 56 may be used to control washing machine system elements and to execute functions beyond those specifically described herein.

Heating elements 118, 120 are controlled by microcomputer 104 in response to outputs of a known temperature sensor 124 and are regulated by a known thermostat switch 126. Microcomputer 104 activates or deactivates heating elements 118, 120 to maintain a selected one of a plurality of heater settings corresponding to a selected dry cycle. In general, temperature sensor 124 is employed so that heating elements 118, 120 may be energized to bring a temperature of the circulated air within drum 26 (shown in FIG. 1) to target levels corresponding to the selected heat setting. Thermostat 124 is employed to deactivate one or both of heating elements 116, 118 when air temperature exceeds predetermined limits.

While one temperature sensor 122 and one thermostat 124 are illustrated in FIG. 2, it is recognized that more than one temperature sensor and more than one thermostat may be employed in further and/or alternative embodiments of the invention. For example, a temperature sensor and/or a thermostat may be employed with each of heating elements 118, 120.

Additionally, control system 100 includes an over-voltage control device 128 that maintains current flow through heaters 118, 120 at levels below those that would trip a circuit breaker 130 associated with the heater control circuit despite fluctuation in input power supply 112. For the reasons set forth below, over-voltage control device 128 operates in a simple and direct manner that is universally applicable across a variety of clothes dryer platforms. While one over-voltage control-device 128 is illustrated, it is contemplated that more than over-voltage control may be used in alternative embodiments. For example, one over-voltage control device could be used with each heater 118, 120.

Figure 3:
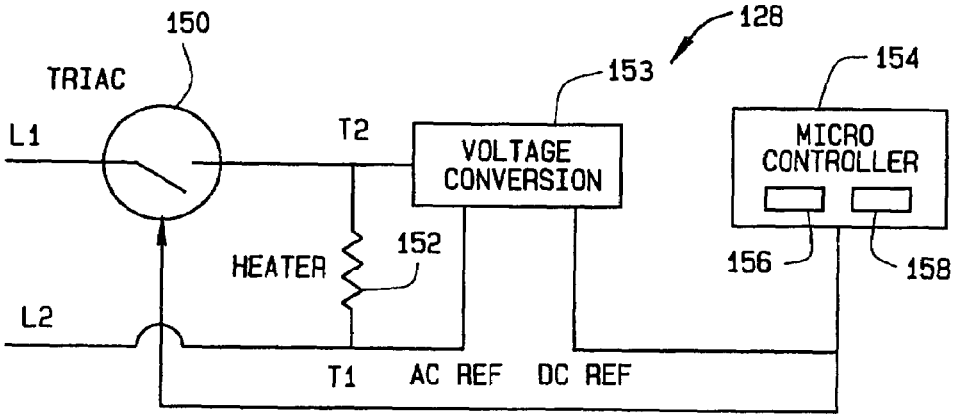
FIG. 3 is circuit schematic of an over-voltage control device for the control system shown in FIG. 2.

FIG. 3 is circuit schematic of over-voltage control device 128 including a power supply switch device 150 connected between input power lines L1 and L2 for energizing a heater 152 (such as one of heaters 118, 120 shown in FIG. 2). AC voltage supplied to heater 152 is monitored across heater terminals T1 and T2 and is fed to a known voltage converter device 153 that converts the input voltage across terminal Ti and T2 to a DC voltage signal output. The DC voltage signal output is fed to a micro-controller which, based upon the value of the DC voltage signal output, signals switch 150 to open and break the circuit to the heater in an over-voltage condition. In one embodiment, micro-controller 154 is programmed to achieve a step reduction in the applied power to heater 152 by opening switch 150 to regulate the alternating current voltage cycles applied to heater terminals Ti and T2. Specifically, micro-controller 154 operates switch 150 to skip a predetermined number of voltage cycles on a periodic basis, as explained below. By skipping voltage cycles on a periodic basis, the effective voltage over heater 152 is maintained at a level sufficient to prevent circuit breaker trips from excessive current flow through heater 152.

In one embodiment, switch 150 is a known triac switch capable of rapidly switching the input power supply connection to the heater. It is contemplated that other switching devices and schemes could be used in alternative embodiments in lieu of a triac switch.

In an illustrative embodiment, micro-controller 154 includes a known microprocessor 156 for making known decisions and a memory 158 coupled thereto. While in one embodiment, micro-controller 154 is separate from controller 56 (shown in FIGS. 1 and 2), it is appreciated that the functionality of micro-controller 154 could be integrated into controller 56 in an alternative embodiment.

Figure 4:
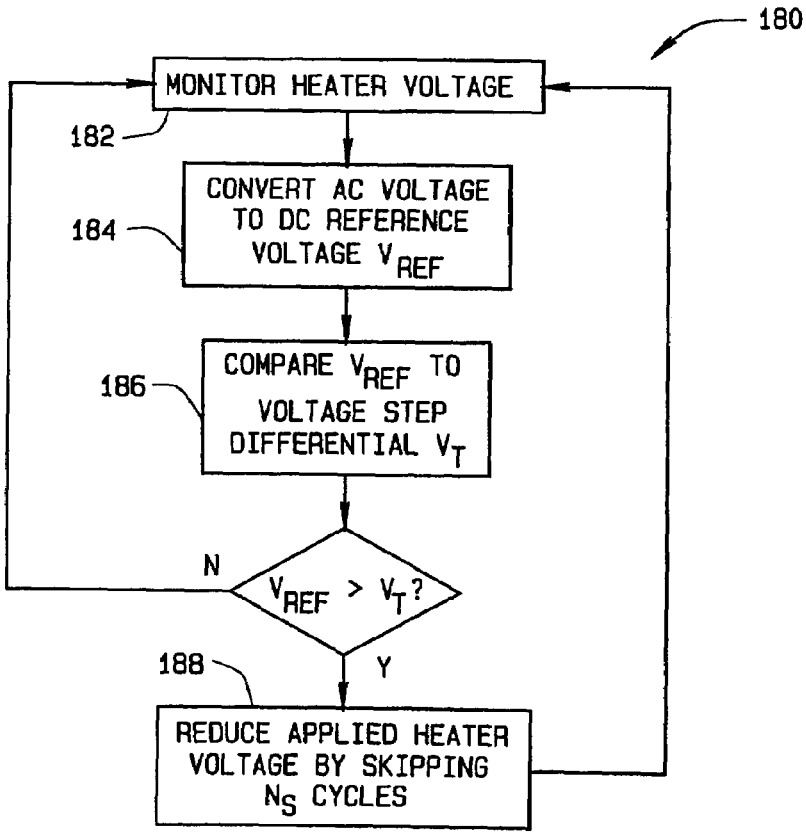
FIG. 4 is a flowchart of an over-voltage control method for the device shown in FIG. 3.

FIG. 4 illustrates a control method 180 executable by micro-controller 154 (shown in FIG. 4) to provide over-voltage control for dryer 10 (shown in FIG. 1). Method 180 achieves over-voltage regulation by changing the effective input power supply to heater terminals T1 and T2 (shown in FIG. 4) over the course of time.

The alternating current power supply input to the heater occurs in a generally sinusoidal voltage waveform at a substantially constant frequency (e.g. 60 Hz), with each sine curve referred to as a cycle. By dividing the cycles into discrete groups, and further by skipping a predetermined number of cycles in each group, a step reduction in the effective voltage applied to the heater terminals may be achieved in a simple and direct manner that is largely independent of specific components and parameters of a particular clothes dryer machine. By varying the number of cycles in the applied voltage groups, and further by varying the number of cycles skipped, the magnitude of the step reduction in the effective voltage supplied to the heaters through switch device 150 (shown in FIG. 3) may be manipulated to obtain over-voltage control of a variety of clothes dryers and for a variety of operating conditions.

In an illustrative embodiment the power supply voltage cycles input to the heater terminals T1 and T2 are divided into groups having a number of voltage cycles $N_c$ within a predetermined time period, referred to herein as a power resolution window, for obtaining a step reduction in the effective voltage across the heater terminals. In an over-voltage condition, a predetermined number of cycles $N_s$ within the power resolution window are skipped to reduce the effective power supplied to the heater. The skipped cycles $N_s$ are obtained by disconnecting the power supply lines L1 (shown in FIG. 3) from heater terminal T2 via opening switch device 150 to open the circuit between L1 and T2 for a sufficient time corresponding to $N_s$ input voltage cycles. When the time for $N_s$ cycles has elapsed, switch 150 is closed for the remainder of cycles $N_c$ in the power resolution window. By skipping cycles $N_s$ in every group of cycles $N_c$, cycles $N_s$ are skipped on a periodic basis to lower the effective voltage applied to the heater terminals. Specifically, in an illustrative embodiment it may be seen that the step reduction in effective voltage is governed by the following relationship.

$$V_{step} = \frac{V_{ave}}{N * t} \tag{1}$$

where $V_{ave}$ is a predetermined desired average voltage across the heater terminals in the dryer (sometimes referred to as a rated voltage of the heaters, e.g., 240V), N is the line input voltage frequency (e.g., 60 Hz), and t is the time in seconds corresponding to the power resolution window. It may be recognized that the product of N and t produces the aforementioned power resolution window.

Thus, applying equation (1), and assuming for example when N is 60 Hz and t is set to 2 seconds, the step reduction in effective heater voltage is:

$$V_{step} = \frac{V_{ave}}{N * t} = \frac{240 \text{ volts}}{60 \text{ Hz} * 2 \text{ sec}} = 2 \text{ volts/cycle.}$$

Thus, for example, if one input cycle is skipped via actuation of switch 150, a step reduction in the effective voltage seen at the heater terminals of approximately 2 volts occurs. Assuming a 60 Hz power source, switch device 150 is opened for $1/60^{th}$ of a second to skip one voltage cycle. As such, a line input voltage of 242 volts may occur while maintaining effective heater voltage at 240V. As a further example, when two input cycles are skipped via actuation of switch 150, a step reduction in the effective voltage seen at the heater terminals of approximately 4 volts occurs. As such, a line input voltage of 244 volts may occur while maintaining effective heater voltage at 240V. Through activation of switch 150, effective heater voltage may be maintained at predetermined levels to avoid circuit breaker trips despite variation in line input voltages above the predetermined level.

By varying t for a given N, it greater or lesser step reductions may be obtained, and by comparing the effective voltage $V_{eff}$ across the heater terminals with a difference between the heater rated voltage $V_{ave}$ and a current voltage step reduction $V_{step}$, the effective heater voltage $V_{eff}$ may be maintained at levels below heater voltages that may trip a circuit breaker associated with the dryer. Control device 128 may therefore avoid a circuit breaker trip despite that a power supply input voltage may reach levels that would otherwise trip the breaker.

Turning now to method 180, micro-controller 154 (shown in FIG. 4) monitors an effective voltage amplitude across the terminals of heater 152. The monitored voltage is converted 184 to a DC reference voltage $V_R$. Once $V_R$ is obtained, $V_R$ is compared 186 to a predetermined threshold voltage $V_t$ corresponding to the rated voltage of the heater. If $V_R$ is less than $V_t$ no action is taken and micro-controller 154 continues to monitor 182 the effective voltage to the heater. If $V_R$ is greater than $V_t$, an over-voltage condition is indicated and micro-controller operates switch device 150 to reduce 188 the applied effective heater voltage to the heater terminals by a predetermined number of input cycles. That is, switch device 150 is operated to skip a number of input voltage cycles $N_S$ within each time period t to achieve a step reduction in the effective voltage supplied to the heater terminals, as described above.

After reducing 188 the effective voltage supplied to the heater through switch device 150, micro-controller continuously monitors 182 the voltage across the heater, converts 184 the AC heater voltage to a DC voltage reference signal, compares the reference signal to the threshold voltage, and reduces 188 effective heater voltage by another step as necessary. Thus, in an exemplary embodiment, step reductions in effective voltage supplied to heater 152 are made in one skip cycle increments each time the reference voltage signal exceeds the voltage threshold value. Since step reductions are made in real time in response to changes in the input voltage from the power supply, the effective voltage applied to the heater is continuously maintained at levels to prevent tripping of a circuit breaker associated with the heater circuit.

In an exemplary embodiment a step reduction counter is employed in conjunction with micro-controller 154 such that the counter is initially set to zero. When a first over-voltage condition is detected the counter is set to one to decrease the applied voltage by one step. If the power supply voltage continues to climb, upon the next occurrence of an over-voltage condition the counter is incremented again and the applied voltage is then decreased by two steps. In the third over-voltage condition as the power supply voltage continues the voltage is decreased by three steps.

In an further embodiment, a lower reference voltage threshold could be introduced to de-activate over-voltage compensation. Thus, if the power supply voltage falls to a predetermined limit or threshold, the voltage step reduction is no longer applied, and switch device 150 remains closed to energize the heater without skipping any voltage cycles (i.e., at the full power of the voltage supply). In such an embodiment, the step reduction would occur when input power supply voltage is climbing above a predetermined level and then is phased out as input power supply voltage falls below a predetermined level.

Figure 5:
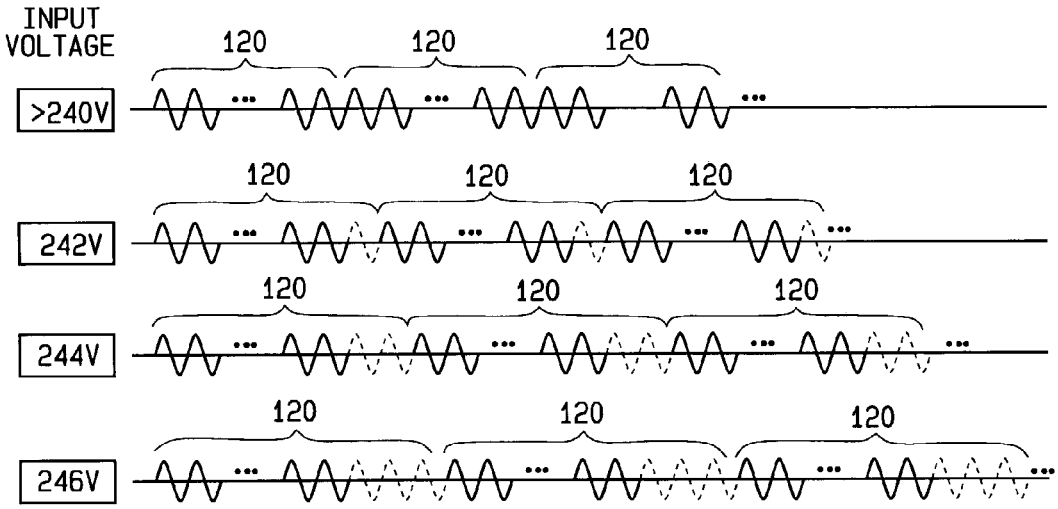
FIG. 5 is a waveform chart illustrating exemplary voltage waveforms produced by the over-voltage device shown in FIG. 3.

FIG. 5 is a waveform chart illustrating exemplary voltage waveforms produced by over-voltage control device 128 (shown in FIG. 3) in accordance with method 180 (shown in FIG. 4).

Referring to FIG. 5, the power supply voltage input is shown on the left and the waveforms applied to the heater terminals are shown on the right. Assume that the input power supply is a 240 VAC system, the threshold voltage is a rated heater voltage of 240V, and that the power resolution time period t is two seconds. As the input power supply voltage fluctuates at or below about 240V, no over-voltage compensation is undertaken by micro-controller 154 (shown in FIG. 3), no input cycles are skipped, and the input voltage and the effective heater voltage correspond one-to-one. Thus, as shown in FIG. 5, when the input voltage is below about 240V no voltage cycles are skipped via activation of switch device 150 (shown in FIG. 3) and each group of 60 cycles in the two second power resolution window is applied in its entirety to the heater terminals.

Assuming that the input voltage increases above about 240 volts, over-voltage compensation is undertaken by micro-controller 154 as the effective voltage to the heater exceeds its rated value. Thus, as shown in FIG. 5, one input voltage cycle (shown in phantom in FIG. 5) is skipped to reduce the effective voltage applied to the heater terminals by one step. According to Equation (1), the voltage step reduction is about 2 volts, and the input voltage can therefore rise to about 242 volts with the effective voltage to the heater remaining at about 240V.

Assuming that the input voltage increases further to 244 volts, micro-controller 154 again detects an over-current condition as the effective heater voltage continues to rise above the rated voltage, and over-voltage compensation occurs again. Micro-controller 154 thereby skips another voltage cycle and brings the total voltage reduction experienced by the heater to two steps. Thus, as shown in FIG. 5, two input voltage cycles (shown in phantom in FIG. 5) are skipped to reduce the effective voltage applied to the heater terminals by two steps. According to Equation (1) set forth above, the voltage step reduction is now about 4 volts, and the input voltage may rise up to about 244 volts while the effective heater voltage is maintained below the rated voltage of 240 volts.

Assuming still further that the input voltage increases to 246 volts, micro-controller 154 again detects an over-current condition as the effective heater voltage continues to rise above its rated voltage, and over-voltage compensation occurs again. Micro-controller 154 thereby skips another voltage cycle and brings the total voltage reduction to three steps. Thus, as shown in FIG. 5, three input voltage cycles (shown in phantom in FIG. 5) are skipped to reduce the effective voltage applied to the heater terminals by three steps. According to Equation (1) set forth above, the voltage step reduction is now about 6 volts, and the input voltage may rise up to about 246 volts while the effective heater voltage is maintained below the rated voltage of 240 volts.

As the input voltage continues to rise, additional over-voltage compensation may take place to keep the effective heater voltage at or below its rated voltage, thereby ensuring that a circuit breaker is not tripped due to excessive voltage in the heater.

Figure 6:
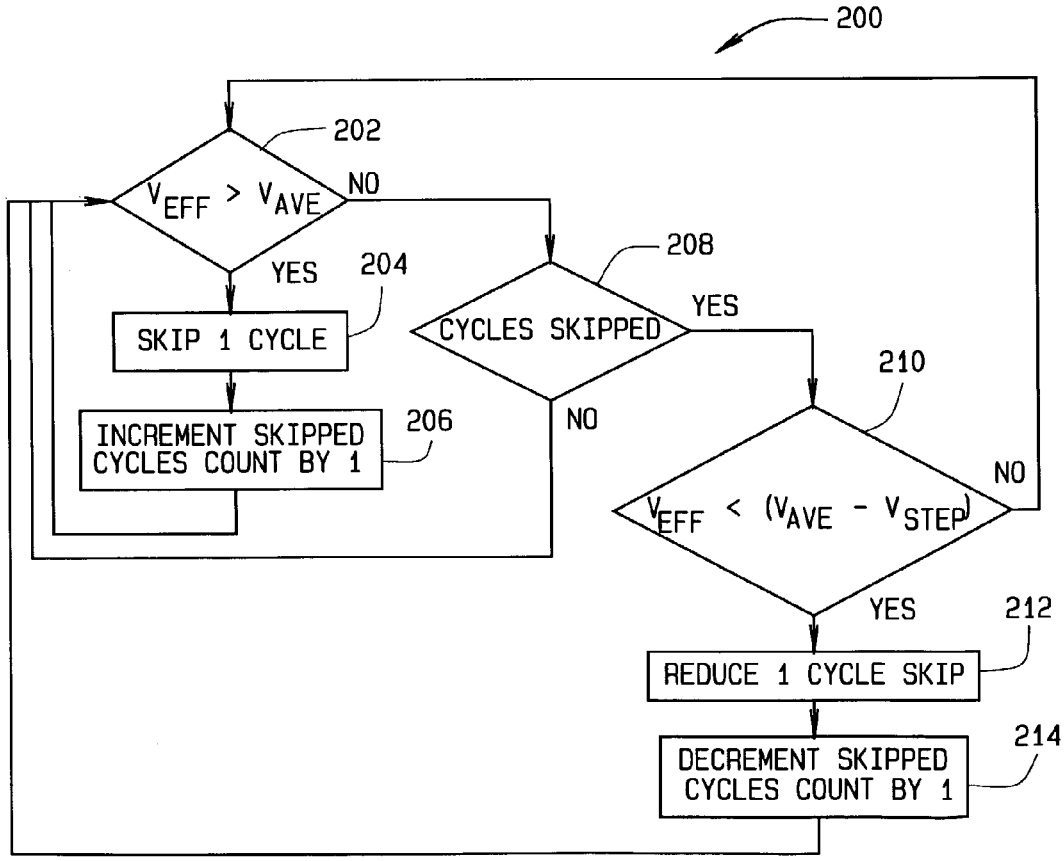
FIG. 6 is another method flow chart of an over-voltage control method executable by the control system shown in FIG. 2.

Behavior of the over-voltage compensation scheme is more specifically illustrated in the method flowchart of FIG. 6.

Method 200 begins by micro-controller 154 comparing 202 the monitored effective voltage $V_{eff}$ across the heater terminals to the rated voltage $V_{ave}$ of the heater. If the effective voltage is greater than the rated voltage, micro-controller 154 activates switch 150 to skip 204 one input voltage cycle by opening switch 150 for one cycle. Once a cycle is skipped 154, a cycle skip counter located in the controller memory is incremented 206 and the algorithm returns to compare 202 the effective heater voltage to the rated voltage.

If the effective heater voltage is less than the rated voltage of the heater, micro-controller 154 determines 208 whether input cycles are being skipped by checking a value of the skipped cycle counter (i.e., whether the skipped cycle counter is greater than zero). If it is determined that cycles are not being skipped, the algorithm returns to compare 202 the effective heater voltage to the rated voltage.

If micro-controller 154 determines 208 that input cycles are being skipped when the monitored effective heater voltage is less than a rated voltage, micro-controller 154 compares 210 the current effective heater voltage value to the a voltage step differential (i.e., the difference between the heater rated voltage and the current applied voltage step reduction by skipping cycles). If the effective heater voltage is greater than the voltage step differential, the algorithm returns to compare 202 the effective heater voltage to the rated voltage.

If micro-controller 154 determines 208 that input cycles are being skipped, and micro-controller 154 further determines that the current effective heater voltage value is less than the voltage step differential, the over-current condition has subsided and micro-controller 154 reduces 212 over-voltage compensation by one cycle (i.e., reduces the number of skipped cycles by one cycle). After reducing 212 the skipped cycles, the skipped cycle counter 212 is decremented 214 and algorithm returns to compare 202 the effective heater voltage to the rated voltage.

By the above-described methodology, over-voltage compensation is phased in and phased out as the power line input voltage fluctuates, and over-voltage compensation is provided on an as needed basis. With appropriate selection of a time t for the power resolution window, over-voltage compensation is achieved to maintain heater voltage at or below the heater rated voltage, thereby ensuring that circuit breakers are not tripped.

Further, as the above described control method and apparatus is not dependant upon a plurality of machine-specific parameters, it is nearly universally applicable to a wide variety of clothes dryer machines. Machine specific experimentation of necessary parameters is therefore avoided and associated costs are reduced. Additionally, the above-described over-voltage control is straightforward and is implemented in a cost effective manner.

It is believed that those in the art of electronic controllers could construct and program the above-described controls without further explanation.

While the invention has been described in terms of various specific embodiments, those skilled in the art will recognize that the invention can be practiced with modification within the spirit and scope of the claims.

What is claimed is:

1. An over-voltage control device for a clothes dryer including an electrical heater coupled to an alternating current power supply, said device comprising, a switch device adapted to connect and disconnect the power supply from the heater; and a micro-controller coupled to said switch device, said switch device responsive to said micro-controller, said micro-controller configured to operate said switch device to skip a predetermined number of power supply voltage cycles in an occurrence of a predetermined time period to maintain an effective heater voltage below a predetermined threshold to avoid tripping of a circuit breaker.

2. An over-voltage control device in accordance with claim 1 wherein said micro-controller is configured to operate said switch to achieve a step reduction in the voltage applied to the heater through said switch device, said step reduction governed by the relationship $$V_{step} = \frac{V_{ave}}{N * t}$$

where $V_{ave}$ is a heater rated voltage, N is a frequency of the input power supply, and t is a predetermined time period for over-voltage compensation.

3. An over-voltage control device in accordance with claim 1 further comprising a voltage converter configured to produce a DC reference voltage corresponding to an operating voltage of the heater.

4. An over-voltage device in accordance with claim 3, said micro-controller configured to compare said reference voltage to a predetermined threshold and operating said switch device if said reference voltage is greater than a predetermined threshold.

5. An over-voltage control system for a clothes dryer including an electrical heater, said control system comprising:

a switch device adapted to disconnect the heater from an alternating current power supply;

a voltage converter coupled to the heater; and a micro-controller coupled to said voltage converter and operatively coupled to the heater, said micro-controller configured to compare a signal from the voltage converter to a predetermined threshold value, and when the reference voltage is greater than the threshold value to operate said switch device to maintain an effective voltage applied to the heater at a voltage level below a rated voltage of the heater.

6. An over-voltage control system in accordance with claim 5 wherein said switch device is operated for a time sufficient to achieve a predetermined step reduction in heater voltage.

7. An over-voltage control system in accordance with claim 6 wherein said voltage step reduction is governed by $$V_{step} = \frac{V_{ave}}{N * t}$$

where $V_{ave}$ is a heater rated voltage, N is a frequency of the input power supply, and t is a predetermined time period for over-voltage compensation.

8. An over-voltage control system in accordance with claim 5 wherein said switch device is a triac switch.

9. An over-voltage control system in accordance with claim 5 wherein said micro-controller is configured to activate said switch device to disconnect the power supply from the heater for an amount of time corresponding to a number of skipped voltage cycles from the power supply.

10. A clothes dryer comprising:

a cabinet;

a drum rotatably mounted within said cabinet;

a fan for circulating air within said drum;

an electrical heater for warming air circulated by said fan;

a switch device coupled between said heater and an alternating current power supply, and a controller coupled to said switch device and configured to operate said switch to achieve a step reduction in the power supply voltage to the heater through said switch device, said step reduction governed by the relationship $$V_{step} = \frac{V_{ave}}{N * t}$$

where $V_{ave}$ is a heater rated voltage, N is a frequency of the input power supply, and t is a predetermined time period for over-voltage compensation.

11. A clothes dryer in accordance with claim 10 further comprising a voltage converter adapted to monitor an actual voltage applied to said heater, said voltage converter generating a DC reference voltage for input to said controller.

12. A clothes dryer in accordance with claim 11 wherein said controller is configured to compare said DC reference voltage to a predetermined threshold voltage, and based upon said comparison, to connect or disconnect said power supply from said heater through said switch.

13. A clothes dryer in accordance with claim 12 wherein said controller is configured to reduce power supply voltage in one step increments.

14. A clothes dryer in accordance with claim 13 wherein said controller comprises a skipped cycle counter, said controller configured to increment a counter value in response to a comparison of said DC reference voltage, said threshold voltage, and said controller configured to decrement the counter value in response to a comparison between the DC reference signal and a difference between the threshold voltage and said step reduction.

15. A method for controlling an electrical heater of a clothes dryer in an over-voltage condition, the clothes dryer including a controller coupled to a switch device for regulating a power supply input to the heater through operation of the switch, said method comprising:

comparing an effective heater voltage to a threshold heater voltage; and when the effective heater voltage is greater than the threshold voltage, opening the switch device to disconnect the power supply from the heater, said opening of the switch device for a predetermined number of voltage cycles on a periodic basis.

16. A method in accordance with claim 15, the dryer further including a voltage converter monitoring actual voltage across said heater, the voltage converter generating a DC voltage reference signal input to said controller, said step of comparing an effective heater voltage to a predetermined reference voltage signal comprising comparing the DC voltage reference signal to a predetermined reference signal.

17. A method in accordance with claim 16 wherein said opening of the switch device comprises operating the switch to achieve a step reduction in the voltage actually applied to the heater from the power supply, the step reduction governed by the relationship $$V_{step} = \frac{V_{ave}}{N * t}$$

where $V_{ave}$ is a heater rated voltage, N is a frequency of the input power supply, and t is a predetermined time period for over-voltage compensation.

18. A method for operating a clothes dryer to avoid tripping of a circuit breaker rated at a threshold voltage for an alternating current power supply, the dryer including an electrical heater, a voltage converter adapted for generating a DC voltage reference signal corresponding to the actual voltage across the heater, a switch device for regulating a power supply input to the heater through operation of the switch, and a controller coupled to the voltage converter and to the switch device, said method comprising:

closing the switch device to energize the heater;

comparing the DC voltage reference signal to a voltage threshold that corresponds to a rated voltage of the heater minus an over-voltage compensation value;

when the DC voltage reference signal is greater than the voltage step differential, opening the switch device to disconnect the heater from the power supply and reduce an effective voltage applied to the heater through the switch device by one voltage step, the voltage step defined by the relationship $$V_{step} = \frac{V_{ave}}{N * t}$$

where $V_{ave}$ is a heater rated voltage, N is a frequency of the input power supply, and t is a predetermined time period for over-voltage compensation;

closing the switch device for a remainder of time t to connect the power supply to the heater; and repeating opening of the switch device to achieve step reduction of voltage cycles to the heater upon the occurrence of every t time period.

19. A method in accordance with claim 18 further comprising:

continuing to compare the DC voltage reference signal to a predetermined reference voltage signal that corresponds to the rated voltage of the circuit breaker; and when the DC voltage reference signal is again greater than the predetermined threshold voltage, opening the switch device to disconnect the heater from the power supply and reduce an effective voltage applied to the heater through the switch device by an additional voltage step.

* * * * *